US008011336B2

(12) United States Patent
Takemoto et al.

(10) Patent No.: US 8,011,336 B2
(45) Date of Patent: Sep. 6, 2011

(54) VARIABLE VALVE OPENING PROPERTY INTERNAL COMBUSTION ENGINE

(75) Inventors: Fumihisa Takemoto, Wako (JP); Mitsuru Sugimoto, Wako (JP); Kiminori Komura, Wako (JP); Takeo Kobayashi, Wako (JP); Hirokazu Tochiki, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 448 days.

(21) Appl. No.: 12/196,374

(22) Filed: Aug. 22, 2008

(65) Prior Publication Data

US 2008/0314346 A1 Dec. 25, 2008

(30) Foreign Application Priority Data

Oct. 5, 2007 (JP) ..... 2007-262021

(51) Int. Cl.
*F01L 1/34* (2006.01)

(52) U.S. Cl. ..... 123/90.16; 123/90.39

(58) Field of Classification Search ..... 123/90.16, 123/90.39

See application file for complete search history.

(56) References Cited

U.S. PATENT DOCUMENTS

2006/0243233 A1* 11/2006 Fujita et al. ..... 123/90.16

FOREIGN PATENT DOCUMENTS

| | | |
|---|---|---|
| JP | 7-63023 | 3/1995 |
| JP | 2005-98279 A | 4/2005 |
| JP | 2005-291011 | 10/2005 |
| JP | 2006-283630 A | 10/2006 |

* cited by examiner

*Primary Examiner* — Zelalem Eshete
(74) *Attorney, Agent, or Firm* — Arent Fox LLP

(57) ABSTRACT

In a variable valve opening property internal combustion engine, a roller link (22) is provided with a cam roller (31) at a free end thereof which engages a cam (3) of a camshaft (4) and a pressure surface (47) of a spring device (41). The roller link is pivotally supported by a bearing portion of a control link (21) which can be adjusted in position by using an actuator (14). The roller link is additionally provided with a roller shaft (31) that engages a slipper surface of a rocker arm (6). The pressure surface of the spring device may be contoured or otherwise inclined so that the direction of action of the spring device on the cam roller can be directed in an optimum direction irrespective of the adjusted position of the pivot point of the roller link.

20 Claims, 9 Drawing Sheets

VARIABLE VALVE OPENING PROPERTY INTERNAL COMBUSTION ENGINE

CROSS REFERENCE TO COPENDING APPLICATION(S)

Reference should be made to the following copending patent application(s) and the contents thereof as well as the contents of any related prior art mentioned therein are hereby incorporated in this application by reference.

Ser. No. 12/203,563 filed Sep. 3, 2008.

TECHNICAL FIELD

The present invention relates to a variable valve opening property internal combustion engine that can change a valve opening property such as the lift of the exhaust and/or intake valves of the engine depending on the operating condition of the engine.

BACKGROUND OF THE INVENTION

Some of the recently developed gasoline and diesel internal combustion engines are fitted with a valve opening property varying mechanism to improve the output and fuel economy of the engine and reduce undesired emissions from the engine. A relatively known form of valve opening property varying mechanism is provided with low speed cams and high speed cams that can be interchangeably used depending on the operating condition of the engine. More recent attempts include those capable of continuously varying the valve opening properties (such as valve lift and valve timing) to further improve the transient response of the engine and to dispense with a throttle valve. See Japanese patent laid open publication No. 2005-291011.

According to a known variable valve opening property engine, a link mechanism is used for varying the valve opening property. In such a case, to prevent uncontrolled movement of the link member, it is desired to keep the link member in contact with an associated member of the valve actuating mechanism such as a cam and a rocker arm by biasing them toward each other by using a spring. In particular, because the relative position of such two members change in response to the varying of the valve opening property, it is necessary that the spring is arranged so as to accommodate such a relative movement.

However, the presence of the link mechanism required for varying the valve opening property necessitates a complication of the valve actuating mechanism, and this imposes a restriction on the positioning of the spring. This in turn prevents the efficient transmission of the spring force to the part where the spring force is needed, Consequently, the spring is required to produce an unduly large spring force in order to provide a required spring force under all conditions.

BRIEF SUMMARY OF THE INVENTION

In view of such problems of the prior art, a primary object of the present invention is to provide a variable valve opening property internal combustion engine that can prevent any uncontrolled movement of a key member of a valve opening property varying mechanism such as a link member under all conditions.

A second object of the present invention is to provide a variable valve opening property internal combustion engine that includes a spring member for urging a key member of a valve opening property varying mechanism to an associated member of a valve actuating mechanism, and is capable of transmitting the spring force of the spring member in an efficient manner irrespective of the position of the key member.

According to the present invention, such objects can be accomplished by providing a variable valve opening property internal combustion engine, comprising: an engine valve provided in a combustion chamber at least partly defined by a cylinder head of the engine and biased in a valve closing direction by a valve spring; a rocker arm pivotally supported by the cylinder head and having an end acting upon a valve stem of the engine valve for opening the engine valve; a camshaft rotatably supported by the cylinder head and carrying a cam; a roller link including a cam engaging part configured to engage the cam and a rocker arm engaging part engaging a slipper surface of the rocker arm, and adjustably supported by the cylinder head for a guided motion of the cam engaging part; a control link for adjusting a trajectory of the guided motion of the cam engaging part; an actuator for actuating the control link; and a spring device mounted on the cylinder head and provided with a pressure surface that acts upon a spring engaging part of the roller link so as to bias the cam engaging part against the cam; wherein the pressure surface extends by a prescribed distance so as to accommodate a guided movement of the spring engaging part caused by an adjustment of the trajectory of the guided motion of the cam engaging part by the control link.

Thus, the roller link can be biased toward the cam, and the jumping, bouncing and other uncontrolled movement of the roller link can be avoided. In particular, if the pressure surface engages a spring engaging part of the roller link which typically consists of a cam roller, and extends over an entire range of movement of the spring engaging part of the roller link, an uncontrolled movement of the roller link can be avoided at all times. Preferably, the spring device comprises at least a pair of compression springs arranged along direction of a movement of the spring engaging part of the roller link so that the springs may be prevented from tilting as they apply a spring force to the spring engaging part.

According to a preferred embodiment of the present invention, the pressure surface is contoured such that an angle between a trajectory of the guided motion of the spring engaging part and a direction of a pressure applied by the pressure surface onto the spring engaging part may be minimized. Most preferably, the pressure surface is given with a varying inclination along the trajectory of the movement of the spring engaging part such that an angle between a trajectory of the guided motion of the spring engaging part and a direction of a pressure applied by the pressure surface onto the spring engaging part may be minimized. Thereby, the spring force may be applied to the spring engaging part in an efficient manner over the entire operating range of the valve opening property varying mechanism, and the need for an unduly large and strong spring device can be avoided.

According to a particularly preferred embodiment of the present invention, the rocker arm engaging part of the roller link comprises a roller shaft disposed coaxially with respect to the cam roller, and this may be conveniently used for engaging the slipper surface of the rocker arm. Preferably, the cam roller also serves as the spring engaging part.

Also, in the particularly preferred embodiment, the control link is pivotally supported by a control link pivot shaft extending in parallel with the camshaft and provided with a bearing portion located at a prescribed distance from the control ink pivot shaft, and the roller link is pivotally supported by the bearing portion of the control link via a roller link pivot shaft extending in parallel with the camshaft so that the guided motion of the cam engaging part may be defined by an arcuate path centered around the roller link pivot shaft. Preferably, the actuator comprises a rotary actuator fixedly mount on the cylinder head, and the control link comprises a sector gear in a gearing connection with a pinion mounted on an output shaft of the actuator.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
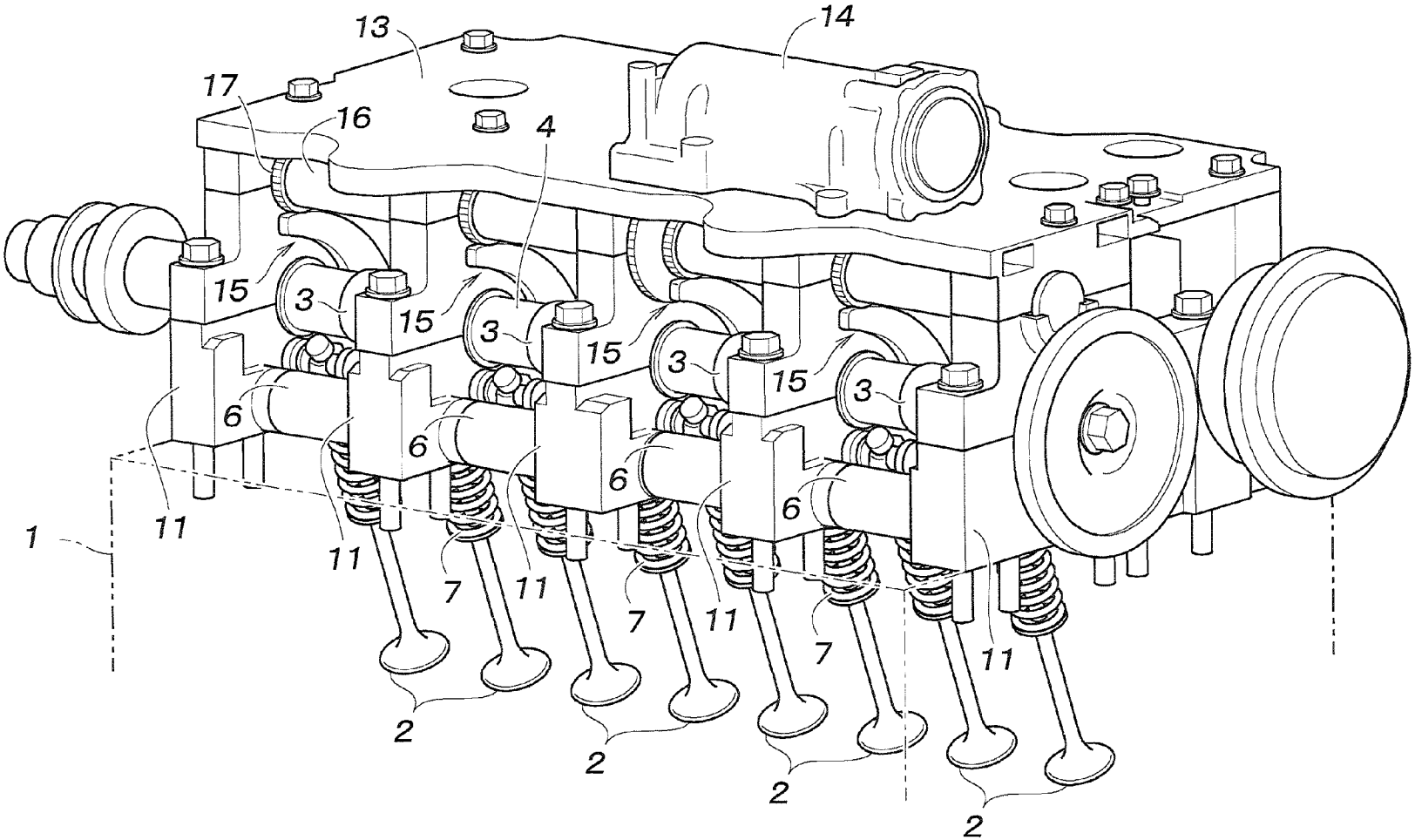
FIG. 1 is a perspective view of an upper part of an internal combustion engine revealing a valve actuating mechanism incorporated with a valve opening property varying mechanism embodying the present invention.
Figure 2:
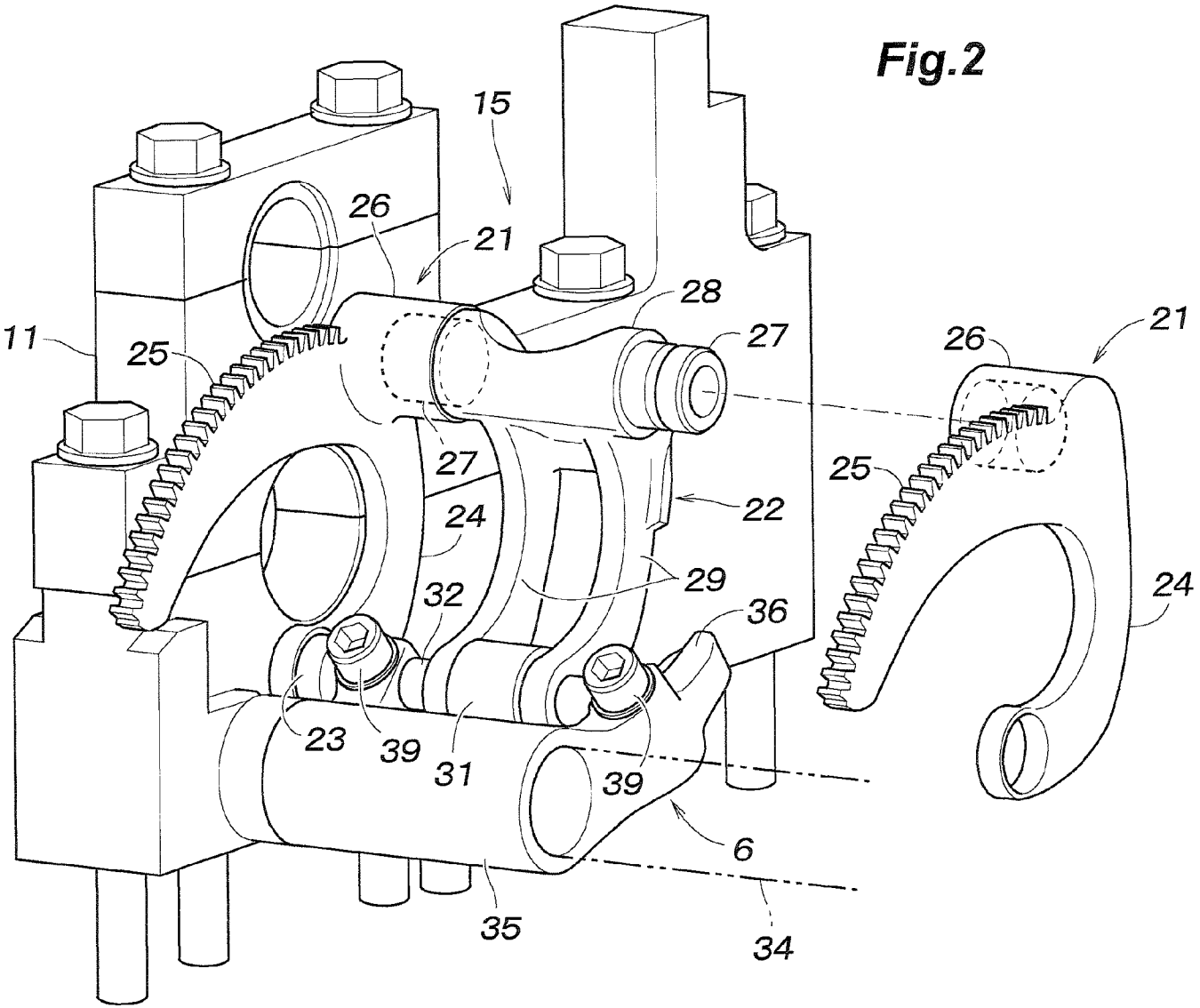
FIG. 2 is a fragmentary exploded perspective view of the valve opening property varying mechanism.
Figure 3B:
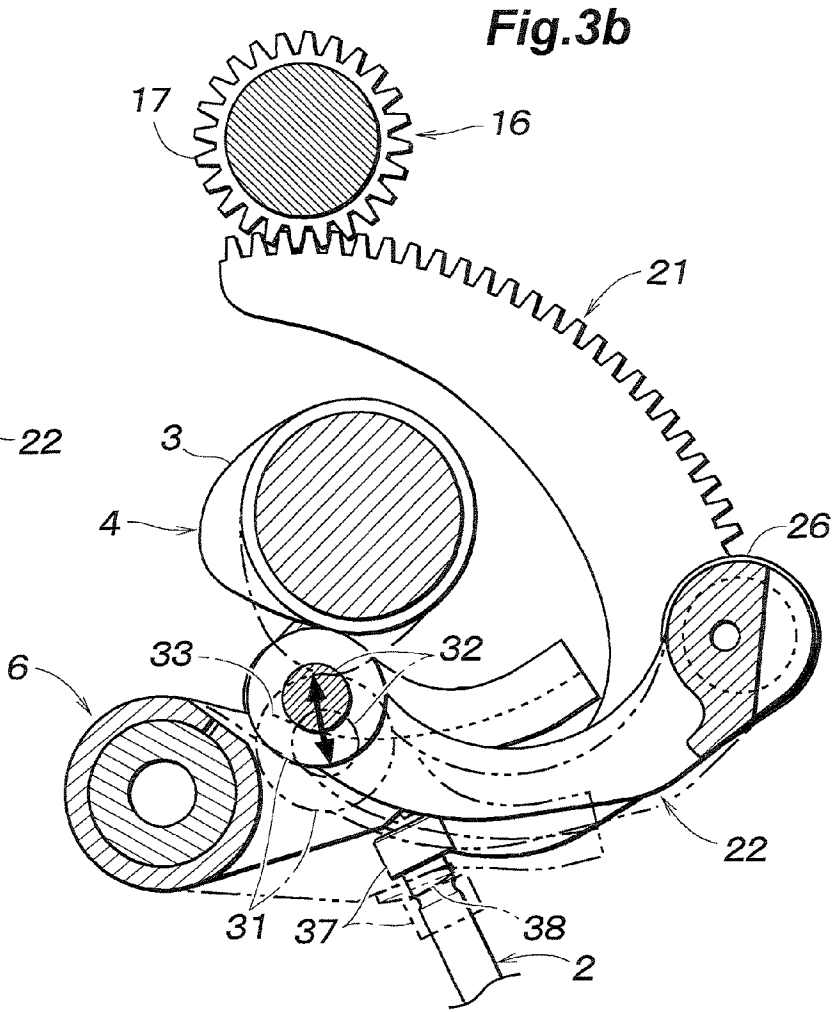
FIG. 3*b* is a fragmentary sectional view of the valve opening property varying mechanism in a maximum valve lift condition.
Figure 3A:
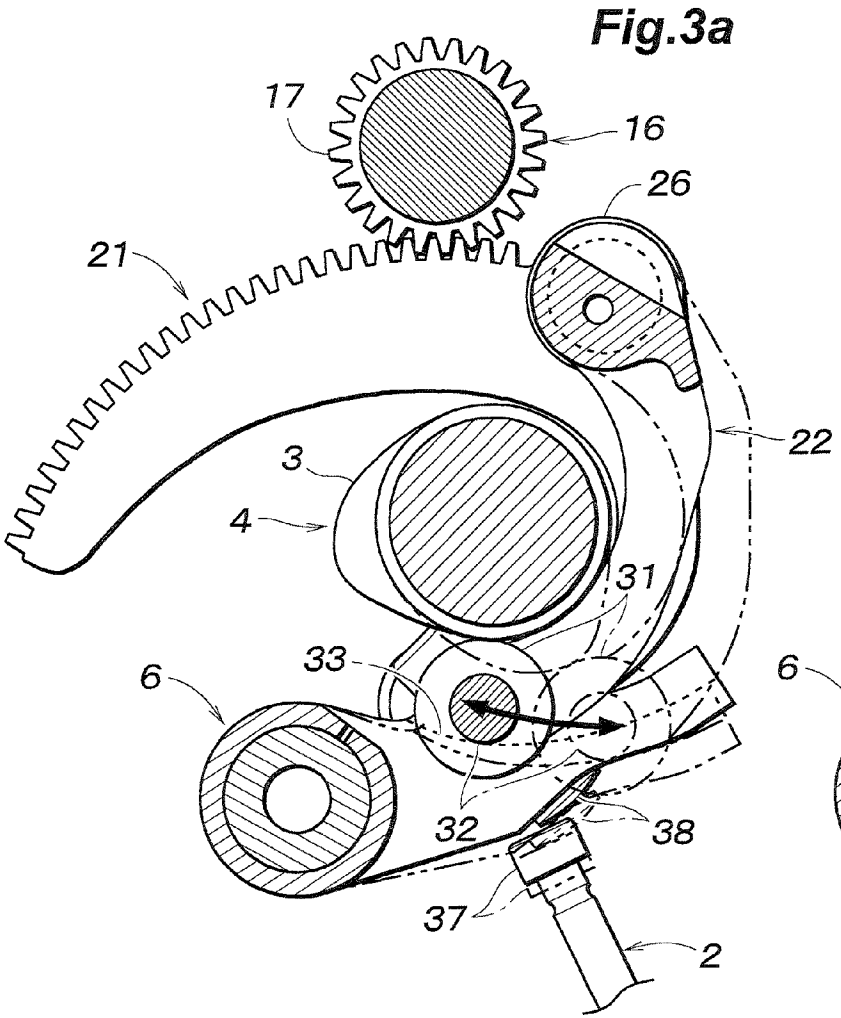
FIG. 3*a* is a fragmentary sectional view of the valve opening property varying mechanism in a minimum valve lift condition.

FIG. 1 is a fragmentary perspective view of an upper part of an internal combustion engine, and FIG. 2 is a fragmentary exploded perspective view of the valve opening property varying mechanism of the engine illustrated in FIG. 1. FIGS. 3*a* and 3*b* are enlarged fragmentary sectional views of the valve opening property varying mechanism in different operating modes.

The illustrated engine consists of an automotive in-line four cylinder engine, and includes a cylinder head 1 defining a combustion chamber for each cylinder and fitted with a pair of exhaust valves 2 in the combustion chamber. The cylinder head 1 is also incorporated with a valve actuating mechanism essentially consisting of a camshaft 4 formed with cams 3, a rocker arm 6 interposed between the valves 2 of each cylinder and the corresponding cam 3, and a valve spring 7 normally urging each valve 2 in a closing direction. Although not shown in the drawings, the cylinder head 1 further includes a pair of intake valves for each cylinder, and the valve actuating mechanism further includes a rocker arm for each cylinder and a valve spring for each intake valve actuated by the cams of the same camshaft or the cams of an intake valve camshaft provided separately from that for the exhaust valves.

The illustrated camshaft 4 is rotatably supported by cam holders 11 mounted on the upper surface of the cylinder head 1 in the form of upright walls by using threaded bolts, and a base plate 13 is attached to the upper surfaces of the cam holders 11 so as to connect them with one another. Thus, the cam holders 11 define a valve actuating chamber for each cylinder.

This cylinder head 1 is incorporated with a valve opening property varying mechanism essentially consisting of a link mechanism 15 for controlling the opening property of each exhaust valve 2. More specifically, a gear shaft 16 is passed across the cam holders 11 in a freely rotatable manner in parallel with the camshaft 4, and an electric motor 14 mounted on an upper surface of the base plate 13 is configured to turn the gear shaft 16 via a gear mechanism not shown in the drawings. The gear shaft 16 is provided with a plurality of gears 17.

Referring to FIG. 2, for each cylinder is provided a gear link (control link) 21 which consists of a C-shaped member and includes an arm portion (base portion) 24 rotatably supported by an adjacent cam holder 11 around an axial line in parallel with the gear shaft 16, a sector gear portion (free end portion) 25 that meshes with a corresponding one of the gears 17 of the gear shaft 16 and a bearing portion (middle portion) 26 extending laterally from a middle part of the gear link 21 in one direction to define a bearing bore. The side surface of the gear link 21 facing away from the bearing portion 26 may be in sliding engagement with the opposing wall surface of the corresponding cam holder 11.

A roller link 22 includes a base end 28 provided with pivot shafts 27 extending from either side thereof and each received by the bearing bore of the bearing portion 26 of the corresponding gear link 21 and a pair of arms 29 extending substantially downwardly from the base end 28 in parallel to each other. A cam roller 31 configured to engage the corresponding cam 3 of the camshaft 4 extends across the free ends of the arms 29, and a roller shaft 32 extends coaxially to the cam roller 31 from each outer lateral side of each arm 29 and is configured to engage a slipper surface 33 of a corresponding rocker arm 6.

The rocker arm 6 includes a base portion 35 pivotally supported by a rocker shaft 34 which extends across the cam holders 11 in parallel with the gear shaft 16 and a pair of arm portions 36 extending from the base portion 35 in parallel to each other. Each arm portion 36 is provided with a tip portion 38 on a lower surface thereof configured to engage a stem end of the corresponding exhaust valve 2 and an adjust screw 39 for adjusting the projecting height of the tip portion 38. The slipper surface 33 is formed on the upper surface of each arm portion 36 of the rocker arm 6.

Thus, as the camshaft 4 turns, each cam 3 engages the corresponding cam roller 31, and the resulting pivotal movement of the roller link 22 causes the exhaust valves 2 to be actuated via the rocker arm 6. Furthermore, as the gear shaft 16 turns, the gear link 21 turns around the pivot shaft 23 thereof (see FIG. 2), and this in turn causes the bearing portion 26 to be displaced along an arc centered around the pivot shaft 23. This arcuate movement of the bearing portion 26 causes a corresponding movement of the pivot center of the roller link 22, and this enables the valve opening property of the exhaust valves to be varied in a continuous manner as will be described hereinafter.

In the idling condition or at a low speed operation of the engine, it is desired that the valve lift is reduced. To accomplish this, the gear link 21 is turned in a fully counterclockwise direction as shown in FIG. 3*a* (zero link angle position). In this case, the bearing portion 26 around which the roller link 22 pivots is located in an uppermost position (above the rocker arm 6) so that the arcuate movement of the roller shafts 32 (cam roller 31) follows a relatively horizontal path. Therefore, when the cam 3 acts upon the cam roller 31, the cam roller 31 and roller shafts 32 move along an arcuate path with a relatively small vertical component so that the roller shafts 32 merely roll over the slipper surfaces 33 of the rocker arm 6, and the swing of the rocker arm 6 (or the lift of the valve 2) is minimized.

On the other hand, in a high speed and/or high load operating condition, the valve lift may be desired to be increased. In such a case, the gear link 21 is turned in a fully clockwise direction as shown in FIG. 3*b* (maximum link angle position which may be about 60 degrees from the zero link angle position). In this case, the bearing portion 26 is located in a lowermost position (on a side of the rocker arm 6) so that the arcuate movement of the roller shafts 32 (cam roller 31) contains a significant amount of vertical component, and the roller shafts 32 push down the slipper surfaces 33 of the rocker arm 6 by a larger stroke, instead of merely rolling over the slipper surfaces 33. As a result, the swing of the rocker arm 6 (or the lift of the valve 2) is maximized.

Figure 4:
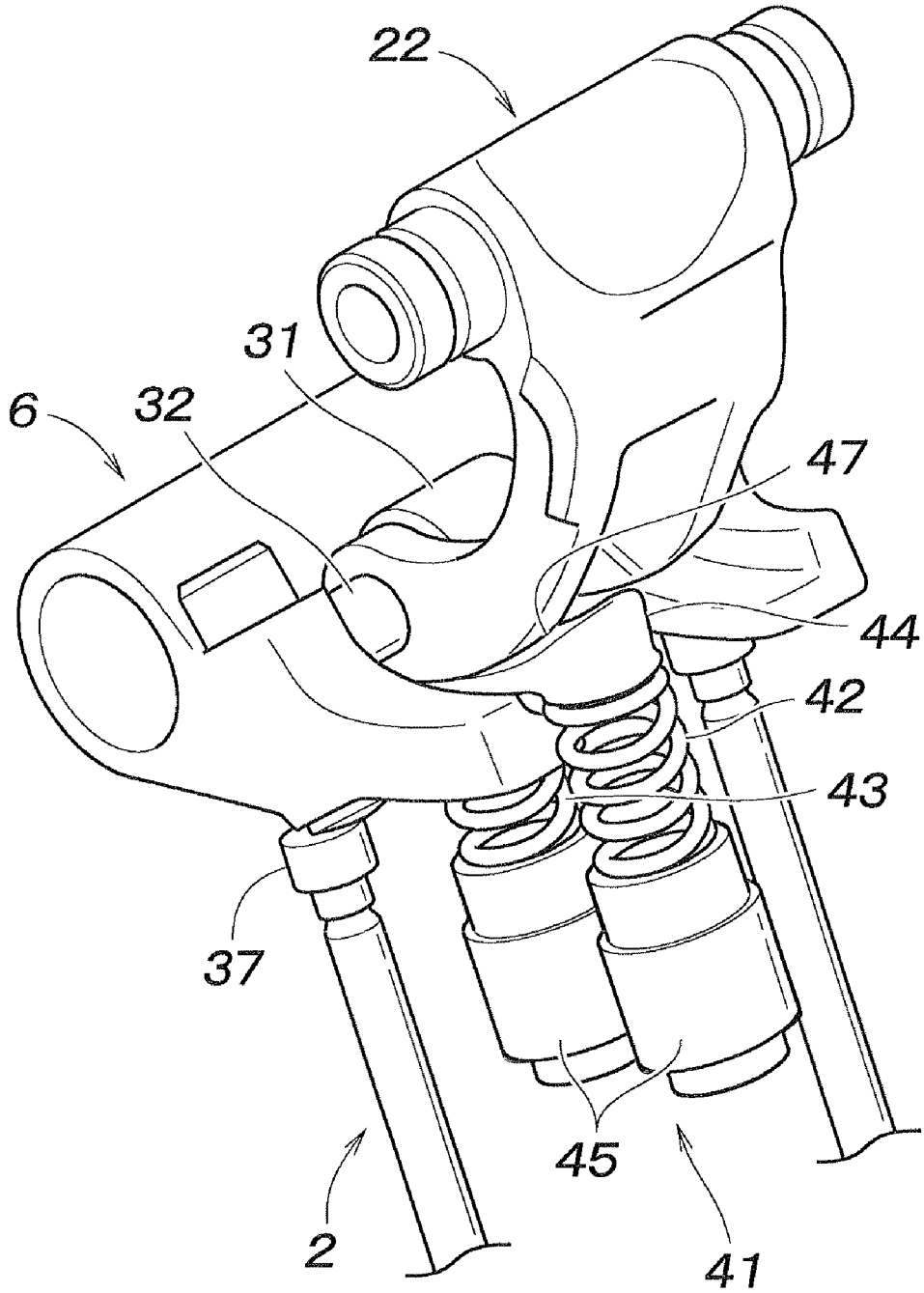
FIG. 4 is a fragmentary perspective view of the valve opening property varying mechanism.
Figure 5:
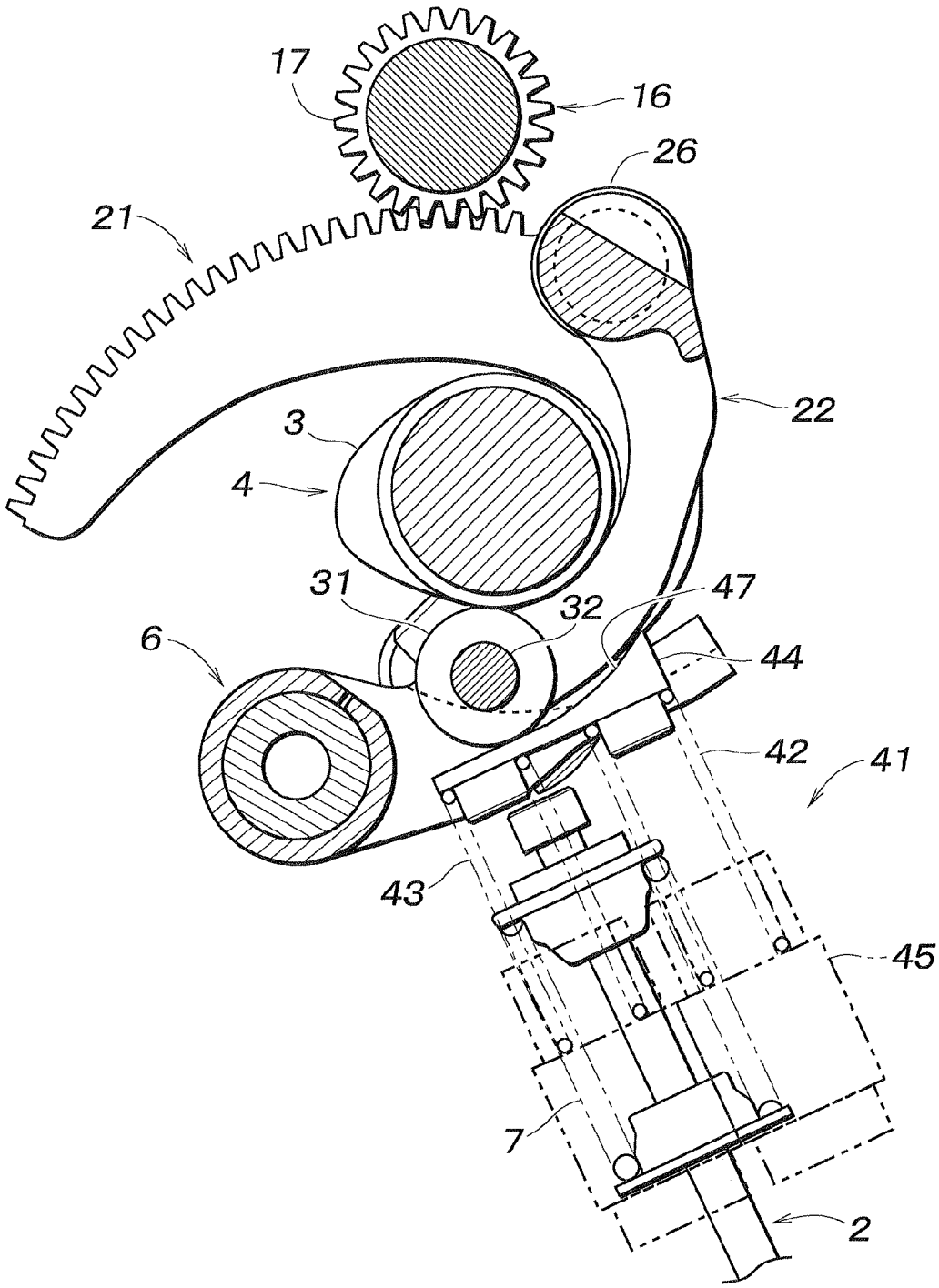
FIG. 5 is a view similar to FIG. 3*a* additionally showing a spring device for urging a cam roller against the valve cam.

FIG. 4 is a perspective view of the valve opening property varying mechanism, and FIG. 5 is a vertical sectional view of the same. As shown in FIG. 4, the valve opening property varying mechanism further comprises a spring device 41 for urging the cam roller 31 of the roller link 22 toward the cam 3. The spring device 41 comprises a pair of compression coil springs 42 and 43, a spring retainer 44 engaging the side of the cam roller 31 facing away from the cam 3 under the spring force of the coil springs 42 and 43 and a spring support 45 supporting the other ends of the coil springs 42 and 43, The spring support 45 may be fixedly secured to the cam holder 11 or the cylinder head 1 either directly or via another member.

Because, the roller link 22 undergoes a pivotal movement around the pivot shaft 27 in response to the rotation of the cam 3 so as to open and close the valve 2, and the position of the cam roller 31 also changes in response to the change in the position of the pivot shaft 27 caused by the movement of the gear link 21 so as to vary the lift of the valve 2. Therefore, the spring retainer 44 has a required length along the path of the movement of the cam roller 31 so as to accommodate such a movement of the cam roller 31 (which is perpendicular to the axial direction of the camshaft 4). Accordingly, the two coil springs 42 and 43 are arranged along this length of the spring retainer 44. Also, the two coil springs 42 and 43 are oriented such that the biasing force of the coil springs 42 and 43 is directed substantially in the same direction as the spring force of the valve spring 7.

Figure 6A:
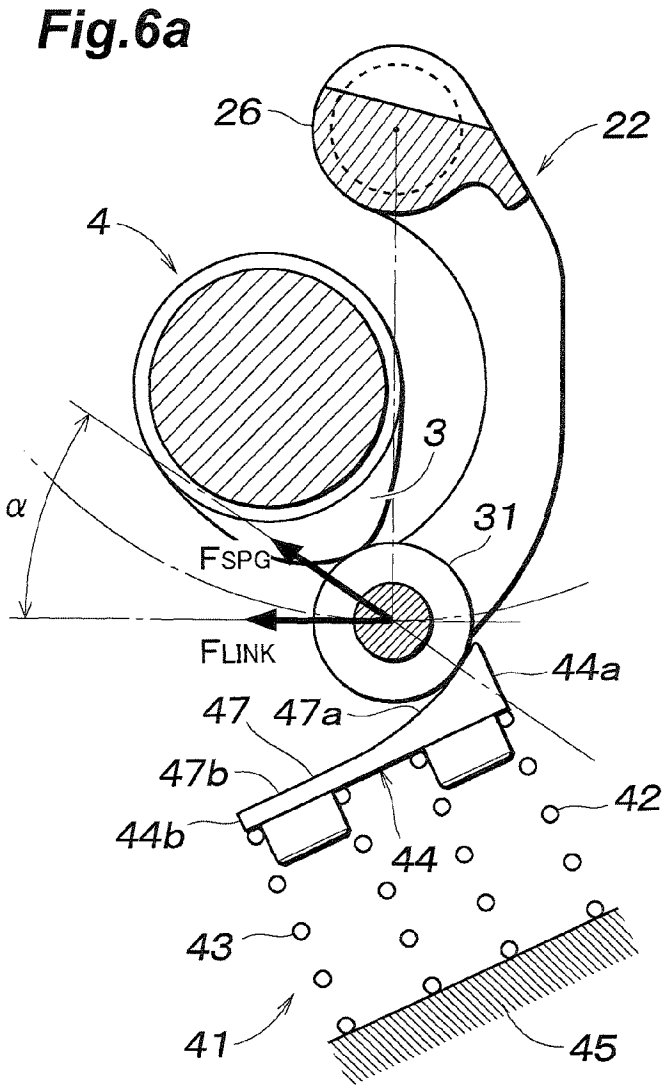
FIG. 6*a* is a fragmentary sectional view showing the positional relationship between the cam roller and a pressure surface of the spring device in the minimum valve lift condition according to a first embodiment of the present invention.
Figure 6B:
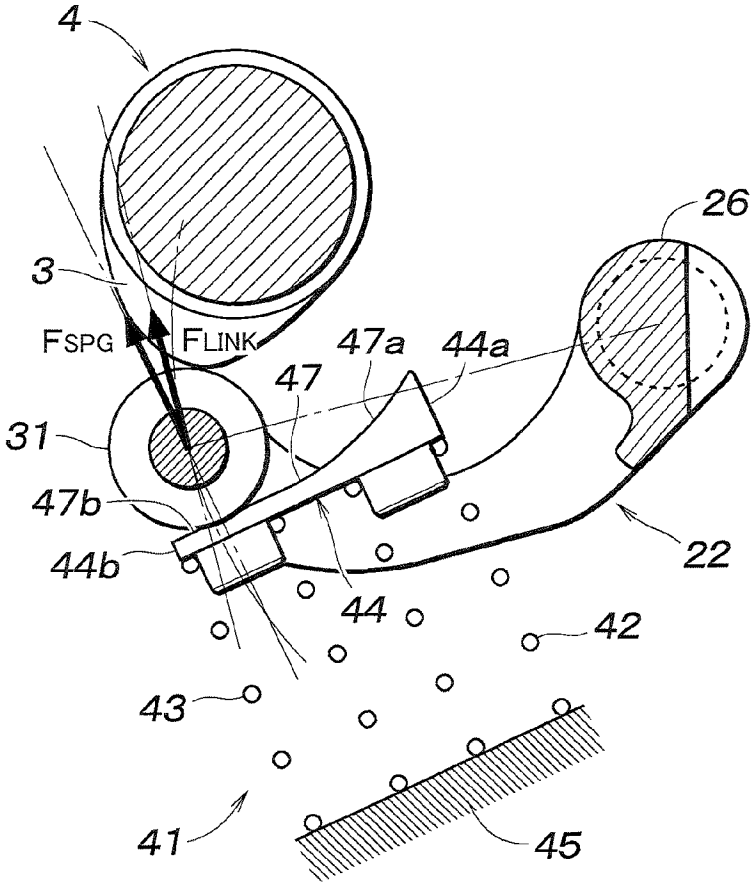
FIG. 6*b* is a fragmentary sectional view showing the positional relationship between the cam roller and a pressure surface of the spring device in the maximum valve lift condition according to the first embodiment of the present invention.
Figure 7B:
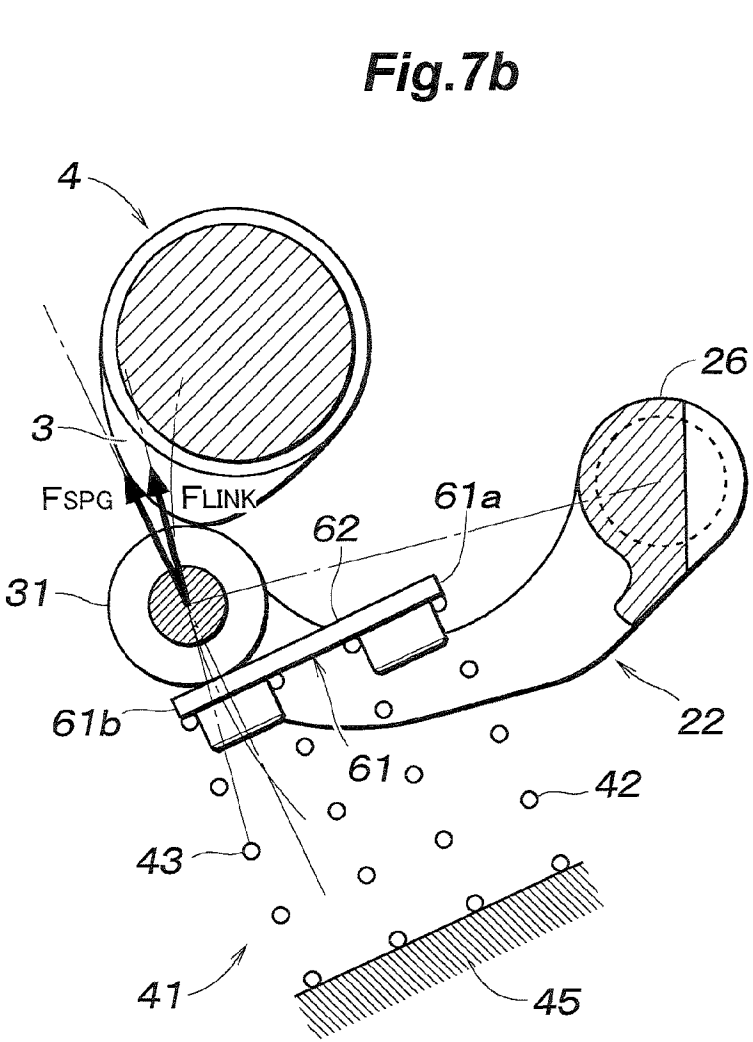
FIG. 7*b* is a fragmentary sectional view showing the positional relationship between the cam roller and a pressure surface of the spring device in the maximum valve lift condition according to the second embodiment of the present invention.
Figure 7A:
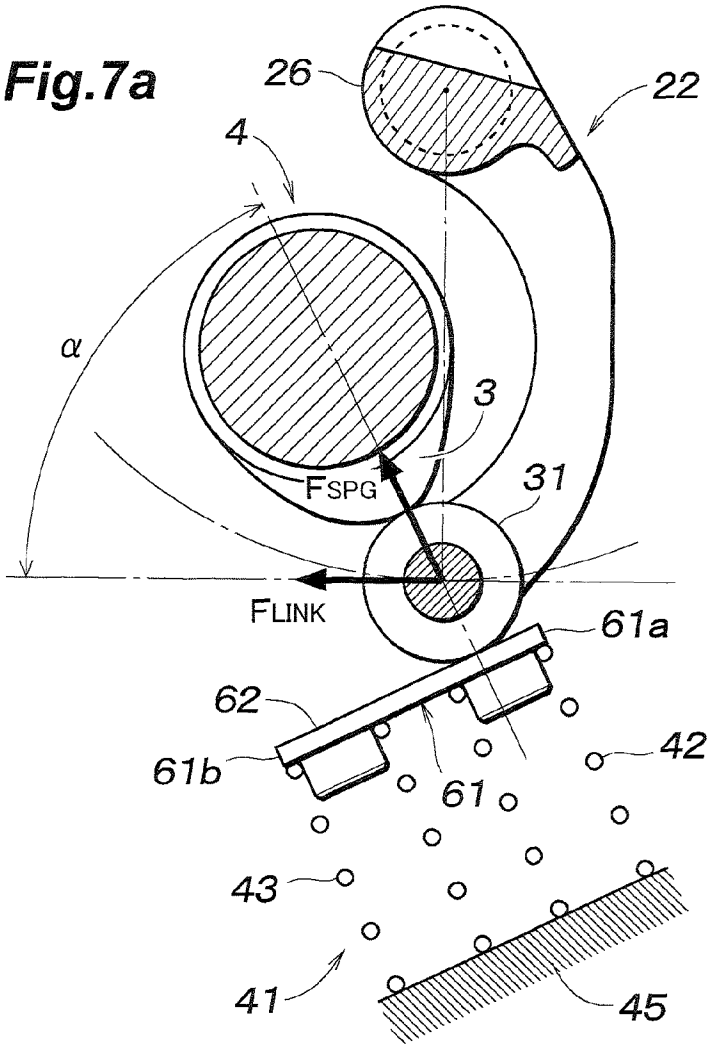
FIG. 7*a* is a fragmentary sectional view showing the positional relationship between the cam roller and a pressure surface of the spring device in the minimum valve lift condition according to a second embodiment of the present invention.

An upper surface of the spring retainer 44 is formed as a pressure surface 47 which transmits the spring force of the coil springs 42 and 43 to the cam roller 31 and is curved as illustrated in FIGS. 6*a* and 6*b*, as opposed to being flat and perpendicular to the axial line of the coil springs 42 and 43 as illustrated in FIGS. 7*a* and 7*b* for comparison, such that the inclination of the pressure surface progressively increases from a high lift end to a low lift end. The low lift end corresponds to the position 44*a* at which the cam roller 31 engages at the zero link angle position (FIG. 6*a*) and the high lift end 44*b* to the position at which the cam roller 31 engages at the maximum link angle position (FIG. 6*b*).

Owing to the curved configuration of the pressure surface 47 of the spring retainer 44, the line of the action of the spring force Fspg of the coil springs 42 and 43 acting upon the cam roller 31 via the spring retainer 44 changes depending on the point of contact of the cam roller 31 on the pressure surface 47. In the zero link angle position (small lift) illustrated in FIG. 6*a*, because the point of contact is located in a part 47*a* of a steep inclination of the pressure surface 47, the line of action of the spring force (Fspg) is at a large angle with respect to the axial lines of the two springs 42 and 43. Also, the line of action of the coil springs 42 and 43 (Fspg) is at a substantial angle $\alpha$ with respect to the tangential direction (Flink) of the pivotal movement of the cam roller 31 around the center of rotation thereof (at 26) which in this case is located above the camshaft 4.

On the other hand, in the maximum link angle position (large lift) illustrated in FIG. 6*b*, because the point of contact is located in a part 47*b* of a little or no inclination of the pressure surface 47 and the plane of the pressure surface is substantially perpendicular to the direction of the spring force of the compression coil springs 42 and 43, the line of action of the spring force (Fspg) is substantially in parallel with the axial lines of the two springs 42 and 43. Also, the line of action of the coil springs 42 and 43 is at a small angle with respect to the tangential direction (Flink) of the pivotal movement of the cam roller 31 around the center of rotation thereof (at 26) which in this case is located on one side of the camshaft 4.

The center lines of rotation of the gear link 21 and roller link 22 are parallel to each other, and the cross sections of the cam roller 31 and the pressure surface 47 of the spring retainer 44 are constant along the axial line which is perpendicular to the paper of the drawings. The pressure surface 47 of the spring retainer 44 is formed as a curved surface in the illustrated embodiment, but may also be formed as a combination of two or more flat planes having progressively steeper inclination angles from one end to the other.

In the second embodiment illustrated in FIGS. 7*a* and 7*b*, the pressure surface 62 of the spring retainer 61 consists of a simple single plane which is perpendicular to the axial lines of the coil springs 42 and 43, and extends from one end 61*a* to the other 61*b*. Therefore, the line of action of the spring force Fspg of the coil springs 42 and 43 acting upon the cam roller 31 via the spring retainer 62 is always in parallel with the axial lines of the coil springs 42 and 43.

In the maximum link angle position (large lift) (with a link angle of 60 degrees, for instance), the first embodiment of the present invention illustrated in FIG. 6*b* is no different from the second embodiment illustrated in FIG. 7*b*. However, in the zero link angle position (small lift), there is a significant difference between the two embodiments of the present invention illustrated in FIG. 6*a* and FIG. 7*a*, respectively. The angle between the line of action of the pressure surface and the axial lines of the coil springs 42 and 43 is substantially equal to each other in the second embodiment illustrated in FIG. 7*a*. In other words, the line of action of the coil springs 42 and 43 is at a larger angle $\alpha$ with respect to the tangential direction of the pivotal movement of the cam roller 31 around the center of rotation thereof (at 26), which in this case is located above the camshaft 4, in the case of the second embodiment illustrated in FIG. 7*a*, as compared with the corresponding state of the first embodiment illustrated in FIG. 6*a*.

Thus, the efficiency of the spring force of the coil springs 42 and 43 in pushing the cam roller 31 at the free end of the cam link 22 is higher for the first embodiment illustrated in FIG. 6*a* than for the second embodiment illustrated in FIG. 7*a*. Therefore, owing to the curved configuration of the pressure surface 47 of the spring retainer 44, the first embodiment is able to effectively push the cam roller 31 against the cam 3 at a relatively constant force over the entire operating range of the valve opening property varying mechanism.

Furthermore, in the case of the second embodiment, particularly in the zero link angle position (small lift), there is a risk that the roller link 22 may pivot beyond the normal range of angular movement under exceptional conditions. However, in the case of the first embodiment of the present invention, owing to the progressively steeper inclination of the pressure surface of the spring retainer toward the end (denoted with numeral 47*a*) corresponding to the zero link angle position (small lift), the cam roller 31 is prevented from dislodging from the pressure surface 47 of the spring retainer 44. Also, as an additional advantage, in the first embodiment, because of the tendency of the lubricating oil to settle on the part of a smaller elevation or the end (denoted with numeral 47*b*) corresponding to the maximum link angle position (large lift), the part where the contact pressure is relatively high is favorably lubricated.

In the first embodiment, the two coil springs 42 and 43 are identical to each other, but may also differ from each other. For instance, the coil spring 42 on the low lift side 44*a* may be made of thicker coil wire or is otherwise configured to produce a greater spring force than the other so that the undesired tilting of the spring retainer 44 may be avoided.

Figure 8:
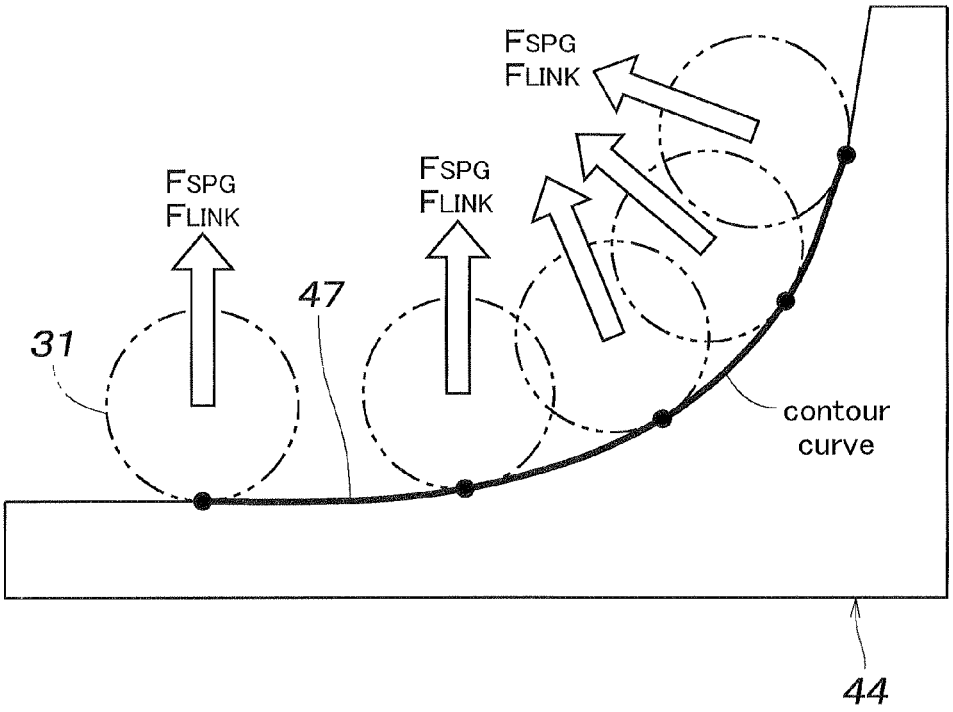
FIG. 8 is a diagram showing the contour of the pressure surface of the spring device.

In the first embodiment illustrated in FIGS. 6*a* and 6*b*, the curvature of the pressure surface 47 of the spring retainer 44 was determined in such a manner that the angle between the line of action of the contact force of the cam roller 31 and the tangential direction of the cam roller 31 around the center of rotation of the roller link 22 (or the force required to turn the roller link 22 around the center of rotation) is reduced to a small value. However, it is also possible to coincide the direction of the line of action of the contact force of the cam roller 31 and the tangential direction of the cam roller around the center of rotation of the roller link 22 at all times as illustrated in FIG. 8. This can be accomplished by determining the configuration of the pressure surface 47 in such a manner that the inclination of the pressure surface 47 at each point is perpendicular to the direction of the movement of the cam roller 31 around the center of rotation of the roller link 22.

Figure 9:
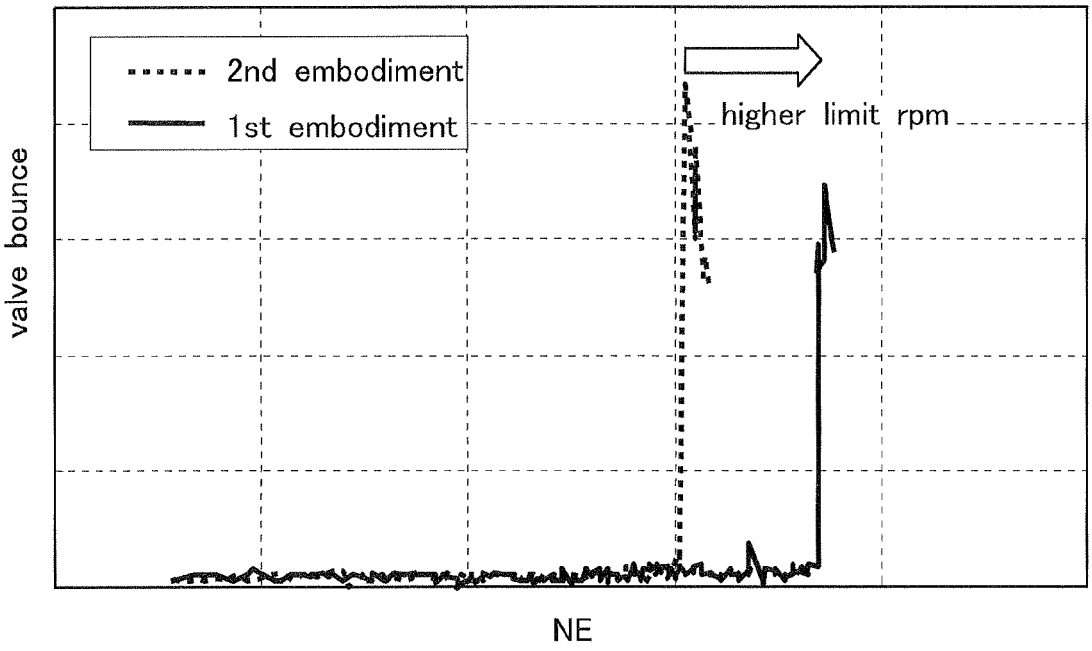
FIG. 9 is a graph comparing the behaviors (bouncing) of the valves of the two embodiments of the present invention.
Figure 10:
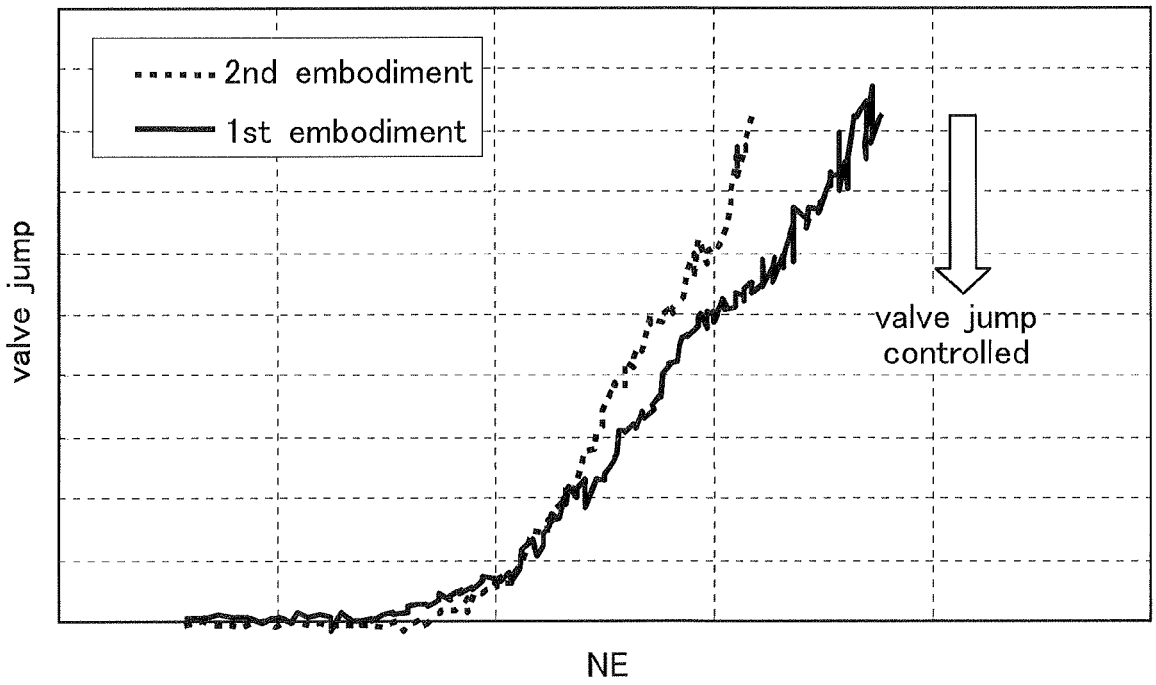
FIG. 10 is a graph comparing the behaviors (jumping) of the valves of the two embodiments of the present invention.

FIGS. 9 and 10 are graphs showing the bounce and jump of the valve in relation with the rotational speed of the engine. The data corresponding to the first embodiment illustrated in FIGS. 6*a* and 6*b* are indicated with solid lines, and the data corresponding to the second embodiment illustrated in FIGS. 7*a* and 7*b* are indicated with dotted lines. It can be seen that the first embodiment is able to control the bounce of the valve to a minimum up to a higher rotational speed than the second embodiment. The same is true with the jump of the valve as shown in FIG. 10.

The illustrated embodiments may be summarized as given in the following. In a variable valve opening property internal combustion engine, a roller link pivotally supported by a cylinder head is provided with a cam roller at a free end thereof which engages a cam of a camshaft and a pressure surface of a spring device. The roller link is additionally provided with a roller shaft that engages a slipper surface of a rocker arm. The pivot point of the roller link can be adjusted by displacing a control link supporting a bearing portion for the pivot point of the roller link. The pressure surface of the spring device is optionally contoured or otherwise inclined so that the direction of action of the spring device on the cam roller can be directed in an optimum direction irrespective of the adjusted position of the pivot point of the roller link.

In the foregoing description of the embodiments of the present invention, the coil springs made of steel were used for urging each cam roller against the corresponding cam, but other forms of springs such as a torsion bar and pneumatic springs may also be used, and springs made of different materials such as rubber may also be used.

Although the present invention has been described in terms of preferred embodiments thereof, it is obvious to a person skilled in the art that various alterations and modifications are possible without departing from the scope of the present invention which is set forth in the appended claims.

The contents of the original Japanese patent application on which the Paris Convention priority claim is made for the present application and the contents of any related prior art mentioned in the disclosure are incorporated in this application by reference.

The invention claimed is:

1. A variable valve opening property internal combustion engine, comprising:

an engine valve provided in a combustion chamber at least partly defined by a cylinder head of the engine and biased in a valve closing direction by a valve spring;

a rocker arm pivotally supported by the cylinder head and having a tip portion contacting a valve stem of the engine valve for opening the engine valve, the tip portion being disposed intermediate a pivotally supported proximal base portion of the rocker arm and a distal free end arm portion of the rocker arm;

a camshaft rotatably supported by the cylinder head and carrying a cam;

a roller link including a cam engaging part configured to engage the cam and a rocker arm engaging part engaging a slipper surface of the rocker arm, and adjustably supported by the cylinder head for a guided motion of the cam engaging part;

a control link for adjusting a trajectory of the guided motion of the cam engaging part;

an actuator for actuating the control link; and a spring device mounted on the cylinder head and provided with a pressure surface that acts upon a spring engaging part of the roller link so as to bias the cam engaging part against the cam;

wherein the pressure surface extends by a prescribed distance so as to accommodate a guided movement of the spring engaging part caused by an adjustment of the trajectory of the guided motion of the cam engaging part by the control link.

2. The variable valve opening property internal combustion engine according to claim 1, wherein the cam engaging part comprises a cam roller.

3. The variable valve opening property internal combustion engine according to claim 2, wherein the rocker arm engaging part of the roller link comprises a roller shaft disposed coaxially with the cam roller.

4. The variable valve opening property internal combustion engine according to claim 2, wherein the cam roller also serves as the spring engaging part.

5. The variable valve opening property internal combustion engine according to claim 1, wherein the spring device comprises at least a pair of compression springs arranged along direction of the guided movement of the spring engaging part.

6. The variable valve opening property internal combustion engine according to claim 1, wherein the pressure surface is contoured such that an angle between a trajectory of the guided motion of the spring engaging part and a direction of a pressure applied by the pressure surface onto the spring engaging part may be minimized.

7. The variable valve opening property internal combustion engine according to claim 1, wherein the pressure surface includes a part having a varying inclination along a trajectory of the guided movement of the spring engaging part.

8. The variable valve opening property internal combustion engine according to claim 7, wherein the pressure surface is given with a varying inclination along the trajectory of the guided movement of the spring engaging part such that an angle between a trajectory of the guided motion of the spring engaging part and a direction of a pressure applied by the pressure surface onto the cam roller may be minimized.

9. The variable valve opening property internal combustion engine according to claim 1, wherein the control link is pivotally supported by a control link pivot shaft extending in parallel with the camshaft and provided with a bearing portion located at a prescribed distance from the control ink pivot shaft, and the roller link is pivotally supported by the bearing portion of the control link via a roller link pivot shaft extending in parallel with the camshaft so that the guided motion of the cam engaging part may be defined by an arcuate path centered around the roller link pivot shaft.

10. The variable valve opening property internal combustion engine according to claim 9, wherein the actuator comprises a rotary actuator fixedly mount on the cylinder head, and the control link comprises a sector gear in a gearing connection with a gear mounted on an output shaft of the actuator.

11. A variable valve opening property internal combustion engine, comprising:

an engine valve provided in a combustion chamber at least partly defined by a cylinder head of the engine and biased in a valve closing direction by a valve spring;

a rocker arm pivotally supported by the cylinder head and having an end acting upon a valve stem of the engine valve for opening the engine valve;

a camshaft rotatably supported by the cylinder head and carrying a cam;

a roller link including a cam engaging part configured to engage the cam and a rocker arm engaging part engaging a slipper surface of the rocker arm, and adjustably supported by the cylinder head for a guided motion of the cam engaging part;

a control link for adjusting a trajectory of the guided motion of the cam engaging part;

an actuator for actuating the control link; and a spring device mounted on the cylinder head and provided with a pressure surface that acts upon a spring engaging part of the roller link so as to bias the cam engaging part against the cam;

wherein the pressure surface extends by a prescribed distance so as to accommodate a guided movement of the spring engaging part caused by an adjustment of the trajectory of the guided motion of the cam engaging part by the control link, wherein the spring device comprises at least a pair of compression springs arranged along direction of the guided movement of the spring engaging part.

12. The variable valve opening property internal combustion engine according to claim 11, wherein the cam engaging part comprises a cam roller.

13. The variable valve opening property internal combustion engine according to claim 12, wherein the rocker arm engaging part of the roller link comprises a roller shaft disposed coaxially with the cam roller.

14. The variable valve opening property internal combustion engine according to claim 11, wherein the pressure surface is contoured such that an angle between a trajectory of the guided motion of the spring engaging part and a direction of a pressure applied by the pressure surface onto the spring engaging part may be minimized.

15. The variable valve opening property internal combustion engine according to claim 11, wherein the pressure surface includes a part having a varying inclination along a trajectory of the guided movement of the spring engaging part.

16. A variable valve opening property internal combustion engine, comprising:

an engine valve provided in a combustion chamber at least partly defined by a cylinder head of the engine and biased in a valve closing direction by a valve spring;

a rocker arm pivotally supported by the cylinder head and having an end acting upon a valve stem of the engine valve for opening the engine valve;

a camshaft rotatably supported by the cylinder head and carrying a cam;

a roller link including a cam engaging part configured to engage the cam and a rocker arm engaging part engaging a slipper surface of the rocker arm, and adjustably supported by the cylinder head for a guided motion of the cam engaging part;

a control link for adjusting a trajectory of the guided motion of the cam engaging part;

an actuator for actuating the control link; and a spring device mounted on the cylinder head and provided with a pressure surface that acts upon a spring engaging part of the roller link so as to bias the cam engaging part against the cam;

wherein the pressure surface extends by a prescribed distance so as to accommodate a guided movement of the spring engaging part caused by an adjustment of the trajectory of the guided motion of the cam engaging part by the control link, wherein the pressure surface is contoured such that an angle between a trajectory of the guided motion of the spring engaging part and a direction of a pressure applied by the pressure surface onto the spring engaging part may be minimized.

17. The variable valve opening property internal combustion engine according to claim 16, wherein the cam engaging part comprises a cam roller.

18. The variable valve opening property internal combustion engine according to claim 17, wherein the rocker arm engaging part of the roller link comprises a roller shaft disposed coaxially with the cam roller.

19. The variable valve opening property internal combustion engine according to claim 16, wherein the pressure surface includes a part having a varying inclination along a trajectory of the guided movement of the spring engaging part.

20. The variable valve opening property internal combustion engine according to claim 19, wherein the pressure surface is given with a varying inclination along the trajectory of the guided movement of the spring engaging part such that an angle between a trajectory of the guided motion of the spring engaging part and a direction of a pressure applied by the pressure surface onto the cam roller may be minimized.

* * * * *